US006238598B1

(12) United States Patent
Chen

(10) Patent No.: US 6,238,598 B1
(45) Date of Patent: May 29, 2001

(54) POSITIVE TEMPERATURE COEFFICIENT (PTC) POLYMER BLEND COMPOSITION AND CIRCUIT PROTECTION DEVICE

(75) Inventor: Jack Jih-Sang Chen, Taipei (TW)

(73) Assignee: Fuzetec Technology Co., Ltd., Hsinchuang City (TW)

( * ) Notice: Subject to any disclaimer, the term of this patent is extended or adjusted under 35 U.S.C. 154(b) by 0 days.

(21) Appl. No.: 09/637,569

(22) Filed: Aug. 11, 2000

(51) Int. Cl.[7] ..... H01B 1/24

(52) U.S. Cl. ..... 252/512; 338/22 R

(58) Field of Search ..... 252/512, 514; 338/22 R

(56) References Cited

U.S. PATENT DOCUMENTS

| | | | | |
|---|---|---|---|---|
| 5,864,280 | * | 1/1999 | Hall | 338/22 R |
| 5,880,668 | * | 3/1999 | Hall | 338/22 R |
| 6,059,997 | * | 5/2000 | Hall | 252/500 |
| 6,114,433 | * | 9/2000 | Chung et al. | 524/495 |

* cited by examiner

*Primary Examiner*—Mark Kopec
(74) *Attorney, Agent, or Firm*—Merchant & Gould P.C.

(57) ABSTRACT

A positive temperature coefficient (PTC) polymer blend composition, and a circuit protection device including a PTC element made from the positive temperature coefficient (PTC) polymer blend composition are disclosed. The composition includes a polymer mixture, containing a crystalline grafted polymer and a crystalline non-grafted polymer, and a conductive particulate material.

18 Claims, No Drawings

POSITIVE TEMPERATURE COEFFICIENT (PTC) POLYMER BLEND COMPOSITION AND CIRCUIT PROTECTION DEVICE

BACKGROUND OF THE INVENTION

1. Field of the Invention

The present invention relates to a positive temperature coefficient (PTC) polymer blend composition and circuit protection device including a PTC element made from the positive temperature coefficient (PTC) polymer blend composition.

2. Description of the Related Art

In recent years, positive temperature coefficient (PTC) polymer materials have been wildly applied to automatic limiting heating cables, over-current protection device e.g. thermistors, touch-control elements, and the like. Due to the extensive development, application and dissemination of electronic products, such as computers and peripheral equipments thereof, cellular phones, secondary rechargeable batteries, network interface boards/machines, modems and electronic facilities and so on, the need for over-current protection devices has remarkably increased. Particularly, the trend for present electronic products is to be light, delicate and accurate, and the characteristics of the over-current protection device made from PTC polymer materials are adapted to meet this trend.

PTC polymer materials primarily are prepared by the addition of conductive additives, such as carbon black and metal powders, to polymer materials. They are generally characterized by an increase in resistance as the operating temperature rises. In particular, when the operating temperature rises around and above the melting point of the PTC polymer material, the resistance increases sharply and logarithmically because of the sharp volume expansion, thus achieving an almost insulated condition. Such a phenomenon is a physical change of the PTC polymer material and is reversible and recurrent and thus, the PTC polymer material is suitable for application to a circuit protection device, such as a thermistor.

PTC polymer materials and circuit protection devices made therefrom have been disclosed in the following patents: U.S. Pat. Nos. 4,237,441, 4,304,987, 4,318,881, 4,226,633, 4,534,889, 4,560,498, 4,845,838, 5,227,940, 5,580,493, 5,747,147, 5,801,612, 3,351,882, 4,689,475, 4,800,253, 5,874,885, 5,940,958, 5,864,280, 5,800,668, and 6,059,997. These prior patents are incorporated herein for reference.

In a conventional circuit protection device made from the PTC polymer material, the PTC polymer material is used for forming a base. Metal foils are laminated or coated on the upper and lower sides of the base to act as electrodes. A conductive wire carrier or conductive sheet is connected to the outer side of the metal foils for enhanced connectivity.

Generally, the polymer materials used in the prior circuit protection devices include polyolefin, such as polyethylene and polypropylene, copolymers of polyolefin and derivatives thereof, such as EVA, EBA, EAA, EMAA, and EMA, and the mixture of polyolefin and copolymers of polyolefin and derivatives thereof. However, there are some defects in the application of the prior polymer materials. For instance, the adhesion of polyolefin to the metal foil electrodes is very poor. The polyolefin adhered to the electrodes is of poor processability and easily peels off and the contact resistance between the polyolefin and the surface of the electrodes is very high. Although the adhesion to the electrodes can be improved by the use of the copolymer of the polyolefin and derivatives thereof, the crystallinity of the copolymer of the polyolefin and derivatives thereof is relatively low and thus, the volume resistivity of the copolymer of the polyolefin and derivatives thereof rises accordingly. In other words, if a low volume resistivity is to be maintained, the amount of the conductive additives contained in the copolymer of the polyolefin and derivatives thereof has to be increased, but the physical properties of the thus formed copolymer composition will become relatively poor. Furthermore, on the basis of trip current being a function of heat transfer which is in terms of a function of melting point of polymer and polymer blends, since the melting point of the copolymer of the polyolefin and derivatives thereof (about 60° C. to 100° C.) is lower than that of polyolefin (about 125° C. to 135° C.) by 35° C. to 75° C., the trip current of the circuit protection device made from such a copolymer will accordingly decrease. In addition, although the adhesion of the mixture of polyolefin and the copolymer of polyolefin and derivatives to the electrodes is improved relative to that of polyolefin, such a mixture also undesirably includes some defects of the copolymer of polyolefin and derivatives thereof.

In view of the above defects, improvements by the use of metal foil electrodes of particular specifications to advance the adhesion property and the processability and to decrease the surface contact resistance have been disclosed in the prior art. U.S. Pat. No. 3,351,882 (Kohler et al.) discloses the use of electrodes of meshed construction to improve the adhesion of polymer materials to electrodes. However, in the disclosed device, the contact resistance between polymer materials and the surface of electrodes is high, and the distribution of current/voltage is uneven.

JP Kokai No. 5-10952 discloses the use of electrodes of a porous metal material having a three-dimensional network structure. However, such electrodes result in high resistance because of the difficulty in connecting a wire carrier.

U.S. Pat. Nos. 4,689,475 and 4,800,253 (Kleiner et al.) disclose a metal foil electrode having a chemically or mechanically micro-roughened surface. However, the roughened process increases the procedure complexity and cost of manufacture.

U.S. Pat. No. 5,874,885 discloses the use of two-layer metal foils including a base comprised of a first metal and protrusions on the base and comprised of a second metal so as to provide surface-roughened metal foil electrodes. Similarly, the roughened process increases the procedure complexity and cost of manufacture.

U.S. Pat. Nos. 5,955,936 and 5,940,958 disclose the use of electrodes characterized by a plurality of voids and made of foam. However, the production of such electrodes increases the procedure complexity and cost of manufacture.

U.S. Pat. Nos. 5,864,280, 5,880,668 and 6,059,997 disclose a crystalline PTC polymer composition, comprising a modified polyolefin and a conductive particulate filler, wherein the modified polyolefin is grafted to the conductive particulate filler. The modified polyolefin is a carboxylic acid-grafted polyolefin. The graft reaction between the modified polyolefin and the conductive particulate filler is carried out at a temperature of 240° C. so as to allow the esterification between the carboxyl group of the modified polyolefin and the conductive particulate. The resultant circuit protection device made from the crystalline PTC polymer composition has good resistance stability. However, the graft reaction between the modified polyolefin and the conductive particulate filler has to be conducted at a temperature 240° C., in close proximity to the critical operating temperature of the used grafted-polyolefin, and thus, the adverse effect, i.e. the decomposition of the carboxylic acid-grafted polyolefin into the carboxylic acid and the polyolefin, is likely to happen. Moreover, the graft temperature of the modified polyolefin and the conductive particulate filler, 240° C., is higher than the common operating temperature, 180° C. to 200° C., by up to 60° C. and increases the difficulty of the compounding process and graft reaction process of the composition.

In addition, the graft level and the uniformity of the modified polyolefin and the conductive particulate filler are difficult to be determined and thus, result in the uncertain yield of the resultant composition and the circuit protection device made therefrom.

There is thus a need for a PTC polymer composition which can be easily produced, and which has a good adhesion to electrodes and a good PTC behavior.

SUMMARY OF THE INVENTION

Therefore, it is an object of the present invention to provide a positive temperature coefficient (PTC) polymer blend composition, which is useful in the manufacture of a circuit protection device and which is capable of providing an improved PTC behavior.

According to one aspect of the present invention, there is provided a PTC polymer blend composition, comprising (a) a polymer mixture containing (i) a crystalline grafted polymer selected from a group consisting of grafted polyolefin, grafted polyolefin derivatives, and grafted copolymers of polyolefin and polyolefin derivatives, the grafted polymer being grafted by a polar group selected from a group consisting of carboxylic acids and derivatives thereof, and (ii) a crystalline non-grafted polymer selected from a group consisting of non-grafted polyolefin, non-grafted polyolefin derivatives, and non-grafted copolymers of polyolefin and polyolefin derivatives, the non-grafted polymer having a melting point substantially the same as that of the grafted polymer; and (b) a conductive particulate material.

According to another aspect of the present invention, there is provided a circuit protection device, comprising (a) a PTC element, having the aforesaid PTC polymer blend composition; and (b) two electrodes, connected respectively to two opposite sides of the PTC element and adapted to be connected a power source.

According to yet another aspect of the present invention, there is provided a PTC polymer blend composition, comprising: (a) a polymer mixture containing (i) a crystalline grafted polymer selected from a group consisting of grafted polyolefin, grafted polyolefin derivatives, and grafted copolymers of polyolefin and polyolefin derivatives, the crystalline grafted polymer being grafted by a polar group selected from a group consisting of carboxylic acids and derivatives thereof, and (ii) a crystalline non-grafted polymer selected from a group consisting of non-grafted polyolefin, non-grafted polyolefin derivatives, and non-grafted copolymers of polyolefin and polyolefin derivatives, the crystalline non-grafted polymer having a melting point substantially the same as that of the grafted polymer; anda conductive particulate material, wherein the composition is prepared by blending and compounding the polymer mixture and the conductive particulate material, at a temperature of 200° C. or less.

DETAILED DESCRIPTION OF THE INVENTION

This invention provides a PTC polymer blend composition, which has an improved adhesion to electrodes and an improved PTC behavior, i.e. low contact resistance, low initial resistance, high trip current, high peak volume resistance, a peel strength comparable to that of prior art, and a circuit protection device of high resistance uniformity and high production yield.

The PTC polymer blend composition of this invention comprises a polymer mixture including a crystalline grafted polymer, which is grafted by a polar group, and a crystalline non-grafted polymer, and a conductive particulate material.

The crystalline grafted polymer is selected from a group consisting of grafted polyolefin, grafted polyolefin derivatives and grafted copolymers of polyolefin and polyolefin derivatives. Preferably, the crystalline grafted polymer is selected from the group consisting of grafted high density polyethylene (HDPE), grafted low density polyethylene (LDPE), grafted linear low density polyethylene (LLDPE), grafted medium density polyethylene (MDPE), and grafted polypropylene (PP) More preferably, the crystalline grafted polymer is grafted HDPE. Preferably, the grafted copolymer of polyolefin and polyolefin derivatives is selected from a group consisting of grafted EVA, grafted EBA, grafted EAA, grafted EMAA, and grafted EMA.

The polar group grafted to the crystalline grafted polymer is selected from the group consisting of carboxylic acid and derivatives thereof. Preferably, the polar group is selected from the group consisting of maleic anhydride, acrylic acid, and acetic acid. More preferably, the polar group is maleic anhydride.

More preferably, the melting point of crystalline grafted polymer is substantially the same as that before grafting.

The crystalline non-grafted polymer is selected from a group consisting of non-grafted polyolefin, non-grafted polyolefin derivatives, and non-grafted copolymers of polyolefin and polyolefin derivatives. Preferably, the crystalline non-grafted polymer is selected from the group consisting of non-grafted HDPE, non-grafted LDPE, non-grafted LLDPE, non-grafted MDPE, and non-grafted PP. More preferably, the crystalline non-grafted polymer is non-grafted HDPE. Preferably, the non-grafted copolymer of the polyolefin and the polyolefin derivatives is selected from a group consisting of non-grafted EVA, non-grafted EBA, non-grafted EAA, non-grafted EMAA, and non-grafted EMA.

The conductive particulate material is selected from a group consisting of carbon black, graphite, carbon fiber and metal powder. The metal powder has a diameter of 0.01 $\mu$m to 100 $\mu$m, and is selected from a group consisting of Ni, Cu, Al, Ag, Au, Fe, Pb, Sn and Zn. Preferably, the conductive particulate material is carbon black and has a structure grade <100, which is measured by the oil (DiButyl Phthalate) absorption method, and a particle size of 40–100 nm.

The PTC polymer blend composition of the present invention comprises 35% to 65% by weight the polymer mixture and 35% to 65% by weight the conductive particulate material. Preferably, the PTC polymer blend composition of the present invention comprises 45% to 50% by weight the polymer mixture comprised of grafted HDPE and non-grafted HDPE and 50% to 55% by weight the conductive particulate material consisted of carbon black.

In the PTC polymer blend composition of the present invention, the polymer mixture comprises 10% to 90% by weight the crystalline grafted polymer and 10% to 90% by weight the crystalline non-grafted polymer. Preferably, the polymer mixture comprises 80% to 50% by weight the crystalline grafted polymer comprised of grafted HDPE and 20% to 50% by weight of the crystalline non-grafted polymer comprised of non-grafted HDPE.

The above composition of the present invention is prepared by blending the polymer mixture and the conductive particulate material at a temperature of 180° to 200° C., so as to prevent a graft reaction between the polymer mixture and the conductive particulate material. Under such an operating temperature, the graft moiety of the crystalline grafted polymer will not decompose, and the resultant composition is found to have a good adhesion to electrodes, a good PTC behavior, and a comparable peel strength to prior PTC compositions.

The invention will now be specifically described with reference to the following examples which are not meant to limit the scope of this invention.

PTC Behavior

EXAMPLE 1

A grafted PE (Fusabond, from DuPont), which was grafted by 1% by weight maleic anhydride, a non-grafted HDPE and 55% by weight carbon black were placed in a C. B. Barbender Plasti-Corder, sequentially, and compounded at a temperature of 190° C. for 4–8 minutes at 30–40 rpm. A suitable amount of the resultant composition, approximately 3 g, was then compressed and molded by a thermal press, at 190° C. for 4–8 minutes, into a sheet having a thickness of about 0.5 mm. The sheet was moved out and placed between two copper foils having a thickness of 0.035 mm and a weight of 1.0 oz. The combination of the sheet and the copper foils was then placed into a compression hot plate mold having a thickness of about 0.5 mm, and placed in a compression press for 4–8 minutes. The resultant thin plate was cut into a number of 0.3 $cm^2$ electrical devices so as to carry out the characteristic analysis. The results of the characteristic analysis are set forth in table 2.

EXAMPLES 2–4

The compositions and electrical devices of Examples 2–4 were produced in substantially the same manner as that of Example 1 except that the compositions were varied as set forth in table 1. The characteristic analysis of Example 1 was followed, and the results are set forth in table 2.

COMPARATIVE EXAMPLES 1–6

The compositions and electrical devices of the comparative Examples 1–6 were produced in substantially the same manner as that of Example 1, except that the compositions were varied as set forth in table 1. The characteristic analysis of Example 1 was followed, and the results are set forth in table 2.

TABLE 1

| | Grafted PE (wt %) | Non-grafted HDPE (wt %) | PE copolymer (wt %) | Carbon black (wt %) |
|---|---|---|---|---|
| Example 1 | 22.5 | 22.5 | — | 55.0 |
| Example 2 | 25.0 | 25.0 | — | 50.0 |
| Example 3 | 33.8 | 11.2 | — | 55.0 |
| Example 4 | 37.5 | 12.5 | — | 50.0 |
| Comparative Example 1 | 45.0 | — | — | 55.0 |
| Comparative Example 2 | 50.0 | — | — | 50.0 |
| Comparative Example 3 | — | 55.0 | — | 45.0 |
| Comparative Example 4 | — | — | 45.0 | 55.0 |
| Comparative Example 5 | — | — | 40.0 | 60.0 |
| Comparative Example 6 | — | 25.0 | 25.0 | 50.0 |

TABLE 2

| Example | Composition | Melting point (° C.) | $R_i$[1] (ohm) | $R_{peak}$[2] (ohm) | Log ($R_{peak}$/$R_i$) | $I_A$[3] (amp) | Peel strength[4] (kg per linear cm) |
|---|---|---|---|---|---|---|---|
| Example 1 | 22.5% grafted PE | 136° C. | 0.115 | $5.57 \times 10^3$ | 4.56 | 1.25 | 1.203 |
| | 22.5% non-grafted HDPE | 128–135° C. | | | | | |
| | 55% carbon black | — | | | | | |
| Example 2 | 25% grafted PE | 136° C. | 1.16 | $1.94 \times 10^8$ | 8.22 | 0.48 | 1.368 |
| | 25% non-grafted HDPE | 128–135° C. | | | | | |
| | 50% carbon black | — | | | | | |
| Example 3 | 33.8% grafted PE | 136° C. | 0.226 | $1.84 \times 10^4$ | 4.91 | 1.21 | 1.122 |
| | 11.2% non-grafted HDPE | 128–135° C. | | | | | |
| | 55% carbon black | — | | | | | |

TABLE 2-continued

| Example | Composition | Melting point (° C.) | $R_i$[1] (ohm) | $R_{peak}$[2] (ohm) | Log ($R_{peak}$ /$R_i$) | $I_A$[3] (amp) | Peel strength[4] (kg per linear cm) |
|---|---|---|---|---|---|---|---|
| Example 4 | 37.5% grafted PE<br>12.5% non-grafted HDPE<br>50% carbon black | 136° C.<br>128–135° C.<br>— | 1.16 | $1.39 \times 10^7$ | 7.08 | 0.58 | 1.360 |
| Comparative Example 1 | 45% grafted PE<br>55% carbon black | 136° C.<br>— | 0.686 | $1.19 \times 10^5$ | 5.24 | 0.70 | 1.898 |
| Comparative Example 2 | 50% grafted PE<br>50% carbon black | 136° C.<br>— | 8.540 | $8.62 \times 10^9$ | 8.00 | 0.15 | 1.684 |
| Comparative Example 3 | 55% non-grafted HDPE<br>45% carbon black | 128–135° C.<br>— | 0.551 | $3.92 \times 10^3$ | 3.85 | 0.72 | 0.209 |
| Comparative Example 4 | 45% PE copolymer<br>55% carbon black | 100° C.<br>— | 18.071 | $8.87 \times 10^5$ | 3.69 | 0.26 | 0.668 |
| Comparative Example 5 | 40% PE copolymer<br>60% carbon black | 100° C.<br>— | 0.223 | $3.53 \times 10^2$ | 3.20 | 0.86 | 0.491 |
| Comparative Example 6 | 25% non-grafted HDPE<br>25% PE copolymer<br>50% carbon black | 128–135° C.<br>100 ° C.<br>— | 0.987 | $2.55 \times 10^3$ | 3.40 | 0.78 | 0.508 |

Note:
[1]: $R_i$ (ohm), initial resistance, measured by microhmmeter, four-point method
[2]: $R_{peak}$ (ohm), peak resistance
[3]: $I_A$ (amp), trip current The minimum current flow through the tested devices to trip the device, namely, the current at which the thermistor changes its state of conductivity to high resistance
[4]: Peel strength (kg per linear cm) The force required to peel off the metal foil having a width of 1 cm, measured by the universal tension meter.

From the results shown in table 2, the PTC polymer blend composition of the present invention, when applied to circuit protection devices, can provide an improved PTC behavior, i.e. low contact resistance, low initial resistance, high trip current, high peak resistance and a peel strength comparable to that of the prior art.

Resistance Uniformity and Production Yield of the Circuit Protection Device

Examples 5–7 and Comparative Examples 7–10 were conducted to compare this invention and the prior art, such as U.S. Pat. Nos. 5,864,280, 5,880,668, and 6,059,997, in the resistance uniformity and production yield of the circuit device.

EXAMPLES 5–7

The compositions and electrical devices of Examples 5–7 were produced in substantially the same manner as that of Example 1 except that the compositions were varied as set forth in table 3. The resultant sheet having a thickness of 0.5 mm conducted a cross-linking reaction under a radiation dosage of 15 mR and then was cut into pieces of 0.35 $cm^2$ or 0.65 $cm^2$. Thereafter, each of the pieces was connected to the lead, soldered with tin, and surface-coated with epoxy.

COMPARATIVE EXAMPLES 7–10

The compositions and electrical devices of Comparative Examples 7–9 were produced in substantially the same manner as that of Examples 5–7 except that the compositions and the compounding temperature were varied as set forth in table 3.

TABLE 3

| Composition | Non-grafted HDPE (wt %) | Grafted PE (wt %) | Carbon black (wt %) | Compounding Temperature (° C.) |
|---|---|---|---|---|
| Example 5 | 26 | 26 | 48 | 200 |
| Example 6 | 24 | 24 | 52 | 200 |
| Example 7 | 22 | 22 | 56 | 200 |
| Comparative Example 7 | — | 45 | 55 | 200 |
| Comparative Example 8 | — | 45 | 55 | 240 |
| Comparative Example 9 | — | 40 | 60 | 200 |
| Comparative Example 10 | — | 40 | 60 | 240 |

The standard derivation and average of the initial resistance of the devices obtained from Examples 5–7 and comparative Examples 7–10 are listed in Table 4.

TABLE 4

| Sample No. | Example 5 | Example 6 | Example 7 | Comparative Example 7 | Comparative Example 8 | Comparative Example 9 | Comparative Example 10 |
|---|---|---|---|---|---|---|---|
| 1 | 1.974 | 0.737 | 0.326 | 3.180 | 1.923 | 0.474 | 0.667 |
| 2 | 2.443 | 0.709 | 0.280 | 2.280 | 2.200 | 0.715 | 0.813 |
| 3 | 2.063 | 0.796 | 0.208 | 2.020 | 2.034 | 0.429 | 0.517 |
| 4 | 2.310 | 0.736 | 0.302 | 2.440 | 1.241 | 0.590 | 0.523 |
| 5 | 1.656 | 0.603 | 0.277 | 2.510 | 1.778 | 0.403 | 0.457 |
| 6 | 1.597 | 0.594 | 0.327 | 2.460 | 1.215 | 0.264 | 2.428 |
| 7 | 2.065 | 0.745 | 0.228 | 2.850 | 1.432 | 0.317 | 0.366 |
| 8 | 2.104 | 0.542 | 0.294 | 1.890 | 2.691 | 0.571 | 2.113 |
| 9 | 2.407 | 0.697 | 0.209 | 2.040 | 2.159 | 0.488 | 0.739 |
| 10 | 1.401 | 0.542 | 0.282 | 2.290 | 1.940 | 0.477 | 0.481 |
| 11 | 1.721 | 0.607 | 0.279 | 1.760 | 2.233 | 0.491 | 0.543 |
| 12 | 2.497 | 0.744 | 0.250 | 2.410 | 1.700 | 0.278 | 2.691 |
| 13 | 1.407 | 0.652 | 0.247 | 1.800 | 1.832 | 0.571 | 0.715 |
| 14 | 1.574 | 0.531 | 0.279 | 1.980 | 2.828 | 0.512 | 0.547 |
| 15 | 2.031 | 0.503 | 0.283 | 3.020 | 3.219 | 0.384 | 0.512 |
| 16 | 1.784 | 0.624 | 0.290 | 2.180 | 2.639 | 0.928 | 0.324 |
| 17 | 2.533 | 0.721 | 0.330 | 2.350 | 2.072 | 0.588 | 0.537 |
| 18 | 1.978 | 0.711 | 0.247 | 2.330 | 2.265 | 0.379 | 0.515 |
| 19 | 2.119 | 0.815 | 0.231 | 2.580 | 2.372 | 0.476 | 0.489 |
| 20 | 1.797 | 0.811 | 0.276 | 2.660 | 2.485 | 0.392 | 0.521 |
| 21 | 2.401 | 0.649 | 0.222 | 3.450 | 2.272 | 0.542 | 0.603 |
| 22 | 1.895 | 0.761 | 0.322 | 2.280 | 3.089 | 0.392 | 0.924 |
| 23 | 1.746 | 0.531 | 0.252 | 4.040 | 2.430 | 0.442 | 0.535 |
| 24 | 1.640 | 0.802 | 0.279 | 2.940 | 2.367 | 0.499 | 0.885 |
| AVG[1] | 1.964 | 0.673 | 0.272 | 2.489 | 2.184 | 0.483 | 0.810 |
| STD[2] | 0.343 | 0.099 | 0.036 | 0.543 | 0.514 | 0.141 | 0.641 |
| %, STD/AVG | 17 | 15 | 13 | 22 | 24 | 29 | 79 |

Note:
[1]: the average of initial resistance
[2]: the standard derivation of initial resistance From the data shown in table 4, the circuit protection devices made in Examples 5–7 of this invention have a lower STD/AVG%, 13–17%, than those of the comparative Examples 7–10, 22–79%. That means the device of this invention has a better resistance uniformity and a production yield than that of the prior art. Particularly, from the comparison of Comparative Examples 7 and 8 and that of Comparative Examples 9 and 10 in the compounding temperature, the compounding temperature of 240° C. resulted in the increase of STD/AVG%. That means that such a temperature is disadvantageous to the compounding operation of PTC composition used in the circuit device and further shows that the compounding temperature range of this invention can improve the defects of the prior art, such as U.S. Pat. Nos. 5,864,280, 5,880,668, and 6,059,997.

The invention shall not be limited by the embodiments described above, which are exemplary and which can be modified in various ways within the scope of protection defined by the appended patent claims.

What is claimed is:

1. A positive temperature coefficient (PTC) polymer blend composition, comprising:

(a) a polymer mixture containing (i) a crystalline grafted polymer selected from a group consisting of grafted polyolefin, grafted polyolefin derivatives, and grafted copolymers of polyolefin and polyolefin derivatives, said grafted polymer being grafted by a polar group selected from a group consisting of carboxylic acids and derivatives thereof, and (ii) a crystalline non-grafted polymer selected from a group consisting of non-grafted polyolefin, non-grafted polyolefin derivatives, and non-grafted copolymers of polyolefin and polyolefin derivatives, said non-grafted polymer having a melting point substantially the same as that of said grafted polymer; and (b) a conductive particulate material.

2. The composition according to claim 1, wherein said crystalline grafted polymer is selected from a group consisting of grafted HDPE, grafted LDPE, grafted LLDPE, grafted MDPE, and grafted PP.

3. The composition according to claim 1, wherein said crystalline non-grafted polymer is selected from a group consisting of non-grafted HDPE, non-grafted LDPE, non-grafted LLDPE, non-grafted MDPE, and non-grafted PP.

4. The composition according to claim 1, wherein said grafted copolymer of polyolef in and polyolefin derivatives is selected from a group consisting of grafted grafted EVA, grafted EBA, grafted EAA, grafted EMAA, and grafted EMA.

5. The composition according to claim 1, wherein said polar group is selected from a group consisting of maleic anhydride, acrylic acid and acetic acid.

6. The composition according to claim 1, wherein said conductive particulate material is carbon black and has a structure grade <120, which is measured by the oil (DiButyl Phthalate) absorption method, and a particle size of 40–100 nm.

7. The composition according to claim 1, wherein said crystalline grafted polymer is grafted HDPE, and said crystalline non-grafted polymer is non-grafted HDPE.

8. The composition according to claim 7, wherein said grafted HDPE is grafted by maleic anhydride.

9. The composition according to claim 8, wherein said grafted HDPE contains less than 1% by weight maleic anhydride.

10. The composition according to claim 1, comprising 35% to 65% by weight said polymer mixture and 35% to 65% by weight said conductive particulate material.

11. The composition according to claim 10, comprising 45% to 55% by weight said polymer mixture and 45% to 55% by weight said conductive material.

12. The composition according to claim 11, wherein said polymer mixture comprises grafted HDPE and non-grafted HDPE, and said conductive material is carbon black.

13. The composition according to claim 1, wherein said polymer mixture comprises 10% to 90% by weight said crystalline grafted polymer and 10% to 90% by weight said crystalline non-grafted polymer.

14. The composition according to claim 13, wherein said polymer mixture comprises 50% to 80% by weight said crystalline grafted polymer and 20% to 50% by weight said crystalline non-grafted polymer.

15. The composition according to claim 14, wherein said crystalline grafted polymer is grafted HDPE, and said crystalline non-grafted polymer is non-grafted HDPE.

16. A circuit protection device, comprising:

(a) a PTC element, having a PTC polymer blend composition as claimed in claim 1; and (b) two electrodes, connected respectively to two opposite sides of said PTC element and adapted to be connected to a power source.

17. The circuit protection device according to claim 6, wherein said electrodes are further connected to a conductive wire carrier or a conductive sheet.

18. A positive temperature coefficient (PTC) polymer blend composition, comprising:

(a) a polymer mixture containing (i) a crystalline grafted polymer selected from a group consisting of grafted polyolefin, grafted polyolefin derivatives, and grafted copolymers of polyolefin and polyolefin derivatives, said crystalline grafted polymer being grafted by a polar group selected from a group consisting of carboxylic acids and derivatives thereof, and (ii) a crystalline non-grafted polymer selected from a group consisting of non-grafted polyolefin, non-grafted polyolefin derivatives, and non-grafted copolymers of polyolefin and polyolefin derivatives, said crystalline non-grafted polymer having a melting point substantially the same as that of said grafted polymer; and (b) a conductive particulate material;

wherein said composition is prepared by blending and extruding said polymer mixture and said conductive particulate material, at a temperature 200° C. or less.

* * * * *